US009842530B2

(12) United States Patent
Carlsson et al.

(10) Patent No.: US 9,842,530 B2
(45) Date of Patent: Dec. 12, 2017

(54) DYNAMICALLY ESTABLISHED WHITE BALANCE IN VIDEO DISPLAY DEVICE BASED ON AMBIENT LIGHT

(71) Applicant: Sony Corporation, Tokyo (JP)

(72) Inventors: Gregory Carlsson, Santee, CA (US); Steven Richman, San Diego, CA (US); Frederick Zustak, Poway, CA (US)

(73) Assignee: Sony Corporation, Tokyo (JP)

( * ) Notice: Subject to any disclaimer, the term of this patent is extended or adjusted under 35 U.S.C. 154(b) by 82 days.

(21) Appl. No.: 15/006,511

(22) Filed: Jan. 26, 2016

(65) Prior Publication Data

US 2017/0213494 A1 Jul. 27, 2017

(51) Int. Cl.

| | |
|---|---|
| ***G09G 5/10*** | (2006.01) |
| ***G09G 3/20*** | (2006.01) |
| ***G09G 3/36*** | (2006.01) |

(52) U.S. Cl.

CPC ..... *G09G 3/2007* (2013.01); *G09G 3/36* (2013.01); *G09G 2320/0242* (2013.01); *G09G 2320/0666* (2013.01); *G09G 2360/144* (2013.01)

(58) Field of Classification Search

None

See application file for complete search history.

(56) References Cited

U.S. PATENT DOCUMENTS

| | | | |
|---|---|---|---|
| 5,781,399 | A | 7/1998 | Lanigan et al. |
| 6,049,448 | A | 4/2000 | Lanigan et al. |
| 6,285,349 | B1 | 9/2001 | Smith |
| 6,328,651 | B1 | 12/2001 | Lebensfeld et al. |
| 6,628,247 | B2 | 9/2003 | Toffolo et al. |
| 6,920,295 | B2 | 7/2005 | Yoshimura et al. |
| 7,059,159 | B2 | 6/2006 | Lanigan et al. |
| 7,091,857 | B2 | 8/2006 | Lanigan et al. |
| 7,389,432 | B2 | 6/2008 | Chandley et al. |
| 7,501,946 | B2 | 3/2009 | Lanigan et al. |
| 7,772,962 | B2 | 8/2010 | Labowicz et al. |
| 7,806,326 | B2 | 10/2010 | Lanigan et al. |
| 8,054,383 | B2 | 11/2011 | Lee |
| 8,405,674 | B2 | 3/2013 | Sakai et al. |
| 2002/0033791 | A1 | 3/2002 | Arakawa |
| 2002/0075407 | A1 | 6/2002 | Cohen-solal |
| 2003/0076332 | A1 | 4/2003 | Choi |
| 2004/0051705 | A1 | 3/2004 | Lee |
| 2005/0276069 | A1 | 12/2005 | Taniguchi et al. |
| 2006/0071949 | A1 | 4/2006 | Sakuma et al. |
| 2006/0227122 | A1 | 10/2006 | Proctor |
| 2008/0043031 | A1 | 2/2008 | Jagmag |
| 2008/0185976 | A1 | 8/2008 | Dickey et al. |
| 2008/0273027 | A1 | 11/2008 | Feremans |

(Continued)

FOREIGN PATENT DOCUMENTS

| | | |
|---|---|---|
| CN | 104778938 | 7/2015 |

OTHER PUBLICATIONS

Mi-Jack Systems & Technology LLC, "Power in Lock Cargo Anti-Theft Protection", http://www.mjst.com/PIL_Page.htm, 2009.

(Continued)

*Primary Examiner* — Adam R Giesy

(74) *Attorney, Agent, or Firm* — John L. Rogitz

(57) ABSTRACT

The white balance of a display device such as an LCD TV is automatically adjusted based on the color temperature of ambient light.

7 Claims, 2 Drawing Sheets

(56) References Cited

U.S. PATENT DOCUMENTS

| | | | | |
|---|---|---|---|---|
| 2008/0303918 | A1 | 12/2008 | Keithley | |
| 2011/0199350 | A1* | 8/2011 | Wilson | G09G 5/02 345/207 |
| 2013/0050165 | A1 | 2/2013 | Northway et al. | |
| 2013/0050233 | A1* | 2/2013 | Hirsch | G06F 3/038 345/589 |
| 2014/0055481 | A1* | 2/2014 | Gao | G09G 5/02 345/589 |

OTHER PUBLICATIONS

"TCL's LCD TV Backlight Technology Gets MII Approval", http://wwww.globalsources.co/gsol/I/LCD-backlight/a/9000000087736.htm; Jun. 13, 2007.

"TCS3471 Digital Color Light Sensor", http://www.digikey.com/en/product-highlight/a/ams/tcs3471-digital-color-light-sensor, Jan. 25, 2016.

* cited by examiner

DYNAMICALLY ESTABLISHED WHITE BALANCE IN VIDEO DISPLAY DEVICE BASED ON AMBIENT LIGHT

FIELD

The present application relates generally to establishing white balance in video display devices based on ambient light.

BACKGROUND

Ambient light can affect the viewing experience of display devices such as liquid crystal display (LCD) TVs.

SUMMARY

As recognized herein, in addition to automatically adjusting backlighting luminance and/or brightness of a display device based, on ambient light, white balance may also advantageously be established as appropriate for ambient light conditions. Specifically, white balance of a display device may be automatically adjusted based on measurement of the color temperature of the ambient light. Automatically adjusting white balance based on ambient light further optimizes the picture quality and produces a more immersive viewing experience. This adjustment based on ambient light color temperature can compensate for quality-reducing fluorescent incandescent, etc. lighting.

Accordingly, a video display such as but not limited to a LCD includes a light sensor, and control circuitry for controlling the video display to present a demanded image. A processor is configured to receive signals from at least one light sensor representing ambient light. A computer memory includes instructions executable by the processor to establish a white balance for the display using the control circuitry based at least in part on the ambient light represented by the signal front the light sensor.

In some implementations, the video display may include but is not limited to a liquid crystal diode (LCD) display, or an organic light emitting diode (OLED) display or a reflective surface associated with a front projection display device, or a cathode ray tube display, or a screen associated with a rear projection display device. In example embodiments, the instructions can be executable to determine a color temperature of the ambient light represented by the signal from at least one light sensor. The instructions may be executable to determine a white balance based at least in part on the color temperature of the ambient light.

In example implementations, the instructions are executable to determine a backlighting based at least in part on the ambient light represented by the signal from the light sensor, and to control a backlighting circuitry associated with the video display based at least in part on the backlighting. Still further, the instructions may be executable to determine a brightness based at least in part on the ambient light represented by the signal from a light sensor, and to control the control circuitry to establish the brightness.

In another aspect, a method includes receiving a signal from a light sensor representing an ambient light characteristic in a space in which a video display is disposed, and based at least in part on the signal, establishing a while balance for the video display. In one embodiment, the measured ambient light may be associated with the space immediately around the display such as the proximate perimeter of the display (proximate relative to the viewers expected position) and/or the space behind the display.

In another aspect, an apparatus includes at least one computer memory that is not a transitory signal and that comprises instructions executable by at least one processor to receive a signal from an ambient light sensor located adjacent a video display, and based at least in part on the signal, establish a white balance in the video display.

The details of the present disclosure, both as to its structure and operation, can best be understood in reference to the accompanying drawings, in which like reference numerals refer to like parts, and in which:

DETAILED DESCRIPTION

Figure 1:
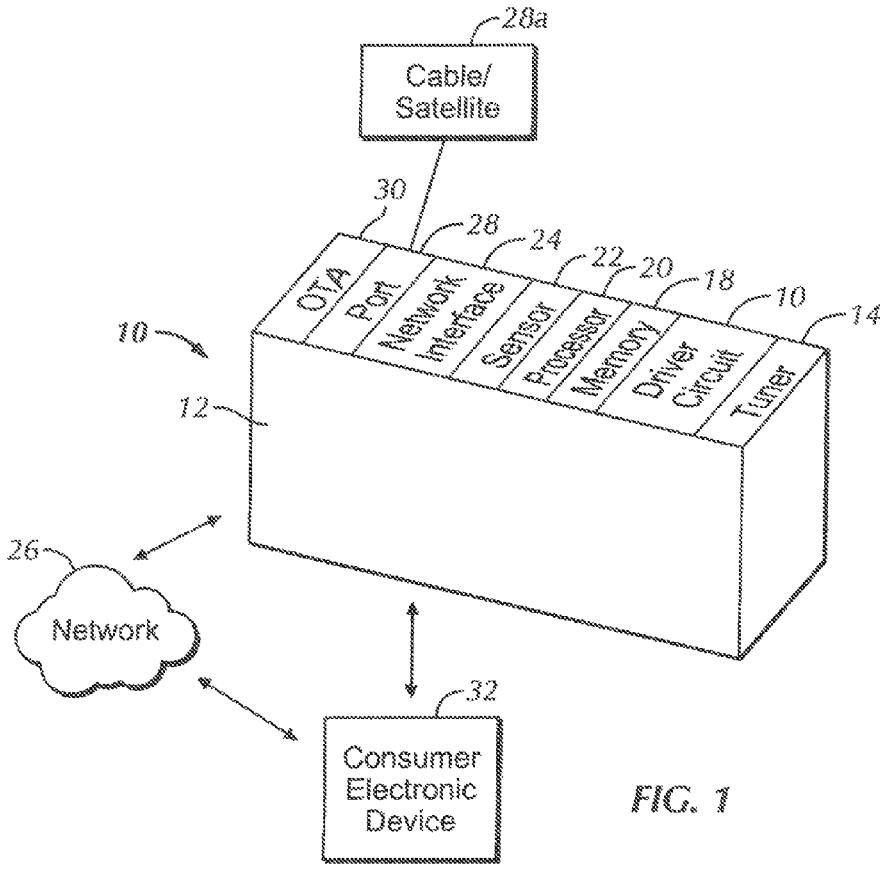
FIG. 1 is a schematic diagram of one embodiment of an example video display device implemented in a TV environment.

This disclosure relates generally to computer systems including aspects of consumer electronics (CE) devices and networks. A system herein may include server and client components, connected over a network such that data may be exchanged between the client and server components. The client components may include one or more computing devices including portable or wall-mounted televisions (e.g. smart TVs, Internet-enabled TVs), front projection video devices, rear projection video devices, portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers and/or gateways may include one or more processors executing instructions that configure the servers to receive and transmit data over a network such as the Internet. Or, a client and server can be connected over a local intranet or a virtual private network. A server or controller may be instantiated by a game console such as a Sony Playstation (trademarked), a personal computer, etc.

Information may be exchanged over a network between the clients and servers. To this end and for security, servers and/or clients can include firewalls, load balancers, temporary storages, and proxies, and other network infrastructure for reliability and security.

As used herein, instructions refer to computer-implemented steps for processing information in the system. Instructions can be implemented in software, firmware or hardware and include any type of programmed step undertaken by components of the system.

A processor may be any conventional general purpose single- or multi-chip processor that can execute logic by means of various lines such as address lines, data lines, and control lines and registers and shift registers.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and digital subscriber line (DSL) and twisted pair wires.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Referring initially to FIG. 1, a display device 10, which may include a LCD display, in accordance with present principles is shown embodied in one intended environment, namely, a video display 12, in some cases a TV tuner 14, display driver circuit 16 for driving the display elements, one or more computer readable storage media 18 such as disk-based or solid storage, and one or more processors 20 accessing the medium 18 in accordance with logic set forth herein. The processor 20 may control the display driver circuit 16 as appropriate to present the demanded image using the display 10, in which case the processor 20 with display driver circuit 16 establish control circuitry. In other implementations the processor 20/display driver circuitry 16 functionalities may be implemented by a single device.

A light sensor 22 communicates signals to the processor 20 representing ambient light. The sensor 22 may include, without limitation, a charge-coupled device (CCD), complementary metal oxide semiconductor (CMOS) sensor, or other sensor and may be instantiated as a digital imaging device. The light sensor 22 may be mounted on or near the display 12, such as on the front periphery of the display 12 or the rear of the display 12. Multiple light sensors 22 may be arranged around the display and their signals averaged or otherwise combine to generate a composite ambient light signal.

The display device 10 may also include one or more network interfaces 24 for communication over at least one network 26 such as the Internet, an WAN, an LAN, etc. under control of the one or more processors 20. Thus, the interface 24 may be, without limitation, a Wi-Fi transceiver, which is an example of a wireless computer network interface, such as but not limited to a mesh network transceiver. It is to be understood that the processor 20 controls the device 10 to undertake present principles, including the other elements of the device 10 described herein such as e.g. controlling the display 14 to present images thereon and receiving input therefrom. Furthermore, note the network interface 24 may be, e.g., a wired or wireless modem or router, or other appropriate Interface such as, e.g., a wireless telephony transceiver, or Wi-Fi transceiver as mentioned above, etc.

In addition to the foregoing, the AVDD 12 may also include one or more input ports 28 such as, e.g., a high definition multimedia interface (HDMI) port or a USB port to physically connect (e.g. using a wired connection) to another CE device and/or a headphone port to connect headphones to the device 10 for presentation of audio from the device 10 to a user through the headphones. For example, the input port 28 may be connected via wire or wirelessly to a cable or satellite source **28*a* of audio video content. Thus, the source 28*a* may be, e.g., a separate or integrated set top box, or a satellite receiver. Or, the source 28*a*** may be a game console or disk player containing content.

The device 10 may include an over-the-air TV broadcast port 30 for receiving OTA TV broadcasts providing input to the processor 20. A battery (not shown) may be provided for powering the device 10.

Still referring to FIG. 1, in addition to the device 10, the system may include one or more other CE device types 32 such as remote controllers for controlling the device 10. When the system is a home network, communication between components may be according to the digital living network alliance (DLNA) protocol. Communication between the device 10 and CE device 32 may be direct (peer to peer) and/or via the network 26. The CE device 32 may include components similar to some or all of the components discussed above in relation to the device 10.

Figure 2:
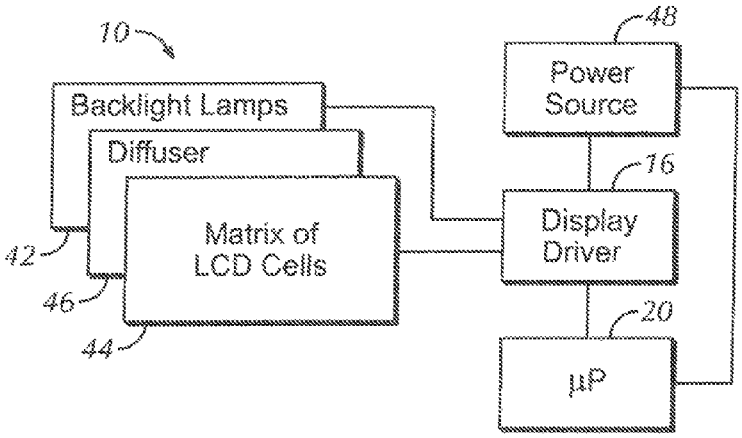
FIG. 2 is a schematic diagram showing internal components of the example display shown in FIG. 1.

FIG. 2 shows that the display 10 may include a planar array 42 of backlight LED lamps as discussed further below. The array 42 provides backlighting for a matrix 44 of LCD cells that are controlled by the control circuitry to provide, in combination with the backlighting, a demanded image in a high definite or ultra high definition format such as 4K, 8K, or higher. Typically, a diffuser assembly 46 may be interposed between the backlighting array 42 and matrix 44 to diffuse backlight from the LED lamps onto the cells of the matrix. The components 42, 44, 46 typically establish three planes of components. A power source 48 is also typically provided to provide illumination power to the display device 10 under control of the control circuitry.

Figure 3:
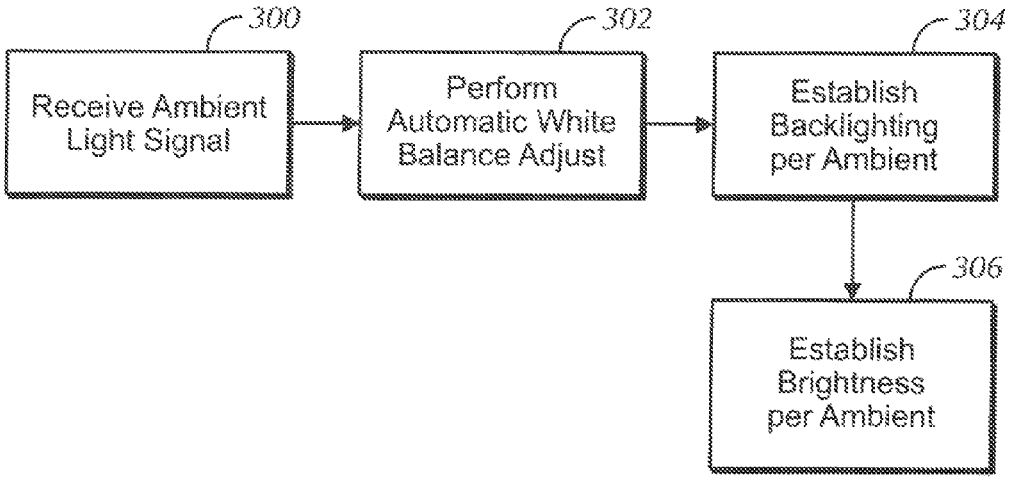
FIG. 3 is a flow chart of example logic.

Turning now to FIG. 3, at block 300 a signal representative of the ambient light surrounding the device 10 is received by, e.g., the processor 20 from, e.g., the light sensor 22. Proceeding to block 302, based on the color temperature of the ambient light as indicated in the signal from the light sensor, the processor 20 controls the driver circuitry 16 or other appropriate circuitry to establish a white balance in the video being presented on the display 12. Thus, the white balance of the video presented on the display 12 may fee automatically and dynamically established as the ambient light surrounding the device 10 changes, to account for the color temperature of the ambient light and, thus, to improve the viewing experience by establishing more realistic color in the presented video.

In non-limiting examples, white balance may be controlled by controlling the gain and DC level of red, green, and blue (RGB) data in the color processing circuitry. In displays with RGB LED backlight the R, G, and B LEDs may be adjusted to move the while point around thus adjusting the color temperature in such displays.

If desired, in addition to using the ambient light signal to establish white balance, the logic can move to block 304 to establish backlighting based on the ambient light signal. This may done by controlling the output of the backlight lamps 42 in FIG. 2. Moreover, in addition to white balance, the ambient light signal may be used at block 396 to establish a brightness of the display 12 by appropriately establishing voltages and/or other parameters of the driver circuitry 16.

The algorithm that performs the white balance adjustment may perform generalized color balancing, sometimes known as illuminant adaptation or chromatic adaptation. The processor 20 essentially scales relative luminance values in the video image so that objects which are believed to be neutral appear so. Thus, if a surface in a video object is assumed to be white, and if a color temperature (expressed in terms of color count in this example) corresponding to white is 255, but the surface assumed to be white has a color count of 240, all red values in the video image may be multiplied by 255/240. This may done analogously for green and blue to result in a color balanced image.

Without limitation, the white balance adjust may employ a so-called "gray world" assumption, which assumes that the average reflectance of a scene is achromatic, meshing that the mean of the red, green, and blue channels in the video are roughly equal. This method may be more appropriate when it is assumed that ambient light will be relatively dark. As an example, assuming the reference channel to be green, the red and blue channels can be chromatically adjusted so that both their means equal the green channel.

As another alternative, a so-called "white patch" method may be used which assumes that perceived white is associated with maximum cone signals. The maximum value of the three channels (R, G, B) are equalized to produce a white patch. Note that a subset of pixels in the signal from the ambient light sensor may be selected to establish the white balance of all the pixels of the video presented on the display 12. Other example non-limiting techniques that can be used at block 302 in FIG. 3 include gamut mapping using a coefficient rule (CRULE), color in perspective, Bayesian formulation, neural networks, adaptive gains, and combinations of the above.

Figure 4:
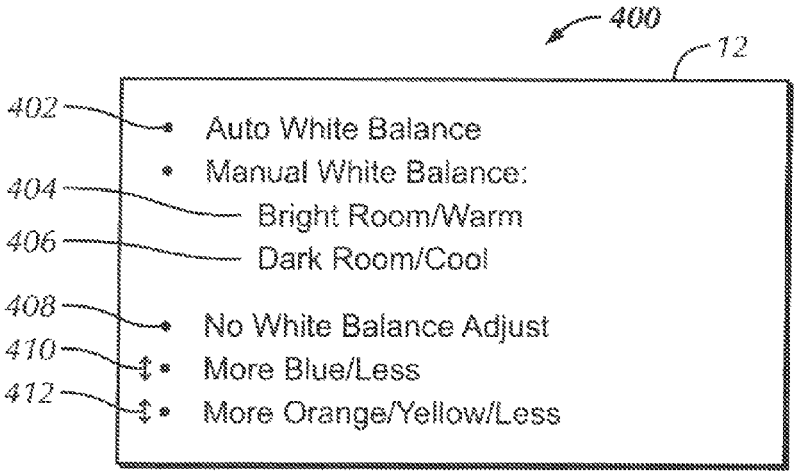
FIG. 4 is a screen shot of an example user interface (UI).

FIG. 4 illustrates an example user interface (UI) 400 that may be presented on the display 12 to allow a user to select (402) to enable the automatic white balance adjust logic of FIG. 3, blocks 300 and 302 based on ambient light. Or, the user may be enabled to manually establish a white balance by selecting (404) a white balance corresponding to a bright or "warm color" room, or by selecting (406) a white balance corresponding to a dark or "cool color" room.

Still further, if desired the user may select (408) to disable white balance adjustment based on ambient light. Yet again, if desired up and down selectors 410, 412 may be provided to respectively enable a user to vary white balance for more (or less) blue and more (or less) orange or yellow or red.

In some implementations, when automatic white balance adjustment is enabled, white balance adjustment may be executed substantially continuously. In other implementations, automatic white balance adjustment, when enabled, may be executed upon enablement and then thereafter only once every "N" seconds, and/or only upon channel change of the AVDD, and/or only if ambient light level changes by more than a threshold brightness and/or by more than a threshold color temperature, and/or only once upon energization of the AVDD. In addition to or in lieu of the periodic adjustments in the preceding sentence, white balance adjustment may be made automatically upon a change of an input video source to the AVDD, e.g., a change-from the input source from a disk player to an Internet application. In addition to or in lieu of the periodic adjustments in the preceding sentence, white balance adjustment may be made automatically upon a change of content, e.g., from streaming content from a streaming content source to changing content to on-demand video. In the case of content change, the source may be from the same "box," but the stream location is different, whereas a source change typically involves changing input source from one box to another.

While the particular DYNAMICALLY ESTABLISHED WHITE BALANCE IN VIDEO DISPLAY DEVICE BASED ON AMBIENT LIGHT is herein shown and described in detail, it is to be understood that the subject matter which is encompassed by the present invention is limited only by the claims.

What is claimed is:

1. An apparatus comprising:

at least one computer memory that is not a transitory signal and that comprises instructions executable by at least one processor to:

receive a signal from an ambient light sensor located adjacent a video display;

based at least in part on the signal, establish a white balance in the video display; and present on the video display at least one user interface (UI) comprising:

a first selector selectable to enable automatic white balance adjustment of the display device;

at least a second selector selectable to manually establish a white balance; and at least a third selector selectable to disable white balance adjustment based on ambient light.

2. The apparatus of claim 1, comprising the at least one processor.

3. The apparatus of claim 1, comprising the video display and the sensor.

4. The apparatus of claim 1, wherein the instructions are executable to:

based at least in part on the signal, establish a backlighting for the video display.

5. The apparatus of claim 1, wherein the instructions are executable to:

based at least in part on the signal, establish a brightness for the display.

6. The apparatus of claim 1, wherein the instructions are executable to:

based at least in part on the signal, determine a color temperature; and establish the white balance based at least in part on the color temperature.

7. The apparatus of claim 1, wherein the at least one UI comprises:

up and down selectors selectable to respectively vary white balance for more (or less) blue and more (or less) orange or yellow or red.

* * * * *